United States Patent [19]

Finsterwalder et al.

[11] 3,935,724

[45] Feb. 3, 1976

[54] APPARATUS FOR STRIPPING HOLLOW ARTICLES OFF A PRESS RAM

[75] Inventors: Kurt Finsterwalder, Goeppingen-Bartenbach; Karl-Heinz Philipp, Goeppingen; Martin Veil, Faurndau; Karl Widmann, Weissenstein; Karl Zwerina, Goeppingen, all of Germany

[73] Assignee: L. Schuler GmbH, Germany

[22] Filed: July 10, 1974

[21] Appl. No.: 487,057

[30] Foreign Application Priority Data

July 28, 1973 Germany ..... 2338490

[52] U.S. Cl. ..... 72/345

[51] Int. Cl.[2] ..... B21D 45/00

[58] Field of Search ..... 72/344, 345, 346, 347

[56] References Cited

UNITED STATES PATENTS

| | | | |
|---|---|---|---|
| 2,345,857 | 4/1944 | Newell | 72/344 |
| 2,753,986 | 7/1956 | Morse | 72/344 |
| 3,295,351 | 1/1967 | Jacobs | 72/344 |

FOREIGN PATENTS OR APPLICATIONS

| | | | |
|---|---|---|---|
| 593,849 | 3/1934 | Germany | 72/345 |

*Primary Examiner*—Lowell A. Larson
*Attorney, Agent, or Firm*—Craig & Antonelli

[57] ABSTRACT

Apparatus for stripping hollow articles off of a press ram including a stripper supporting ring extending circumferentially around the press ram, a plurality of segments mounted on said supporting ring for limited radial displacement with respect to the press ram axis, and a plurality of individual hydraulically cushioned strippers mounted in each of said segments for direct engagement with the article to be stripped from the press ram. Various preferred embodiments include various mechanisms for permitting and/or positively providing radial displacement of the segments so as to accommodate passage of the press ram and article to be stripped. Several of these preferred embodiments include biasing means such as springs and/or pressure medium forces for biasing the segments radially inwardly and chamfered conical beveled edges on the segments for accommodating an outward biasing force application by way of the article and press ram. Other preferred embodiments include guide tracks rotatably mounted on the supporting ring for engagement with guide rollers carried by the segments for effecting a positive radial displacement of the segments sequentially timed to coincide with the press operation to prevent radial inward displacement of the segments during other than the stripping operations. In certain of the embodiments using the guide rollers, the guide rollers are maintained in contact with the guide tracks by spring means and/or pressure medium applied forces. In another preferred embodiment, two sets of guide rollers are provided for effecting a positive inward and a positive outward displacement of the segments.

38 Claims, 9 Drawing Figures

APPARATUS FOR STRIPPING HOLLOW ARTICLES OFF A PRESS RAM

BACKGROUND AND SUMMARY OF THE INVENTION

This invention relates to a stripping mechanism for removing drawn or extruded hollow articles from a press ram. More specifically, this invention relates to stripping mechanisms of the type with a stripper supporting ring holding several strippers distributed along the circumference of the press ram with each of these strippers being movable radially in the direction toward the axis of the press ram and away therefrom, as well as individually in the direction of the press ram axis.

In a conventional apparatus of this type (German Pat. No. 593,849), several bearing segments are mounted in a stripper supporting ring to be movable in the direction of the axis of the press ram, and respectively one stripper is disposed in each bearing segment to be movable within limits in the radial direction. In this construction, the bearing segments are under the effect of compression springs with respect to the stripper supporting ring and the strippers are under the effect of compression springs with respect to the associated bearing segments. These compression springs, on the one hand, urge the bearing segments in the direction toward the stripping edge of the hollow article and, on the other hand, urge the strippers inwardly in the radial direction. One disadvantage of this conventional arrangement resides in that hardly more than one stripper can be mounted in each bearing segment. The apparatus thus is composed of many individual parts and therefore becomes susceptible to malfunction if it is desired to provide numerous strippers distributed along the circumference of the press ram in order to obtain a favorable force transmission to the stripping edge of the hollow article during the stripping thereof.

Another conventional apparatus (German Pat. No. 1,285,973) for the stripping of deep-drawn hollow articles from a press ram includes a stripper bearing ring and several strippers distributed over the circumference of the press ram. These strippers are of a segment shape and each stripper is pivotable within limits in its plane in directions toward and away from the press ram and is also movable within limits in the direction of the axis of the press ram. In this system, all strippers are under the effect of two elastic rings, one of which elastically supports all strippers during the stripping step in the direction of the axis of the press ram with respect to the stripper bearing ring, and the other of which, surrounding all strippers together, urges the strippers to pivot radially toward the inside. One disadvantage in this construction is the very limited elastic movability of the individual strippers in the direction of the axis of the press ram.

Both above-described, conventional constructions have the disadvantage in common, first of all, that the elastic forces effective on the individual strippers in the direction of the axis of the press ram and radially inwardly cannot be adapted to the respectively ambient working conditions without exchanging the springs or rings. This has the consequence, with regard to the displacements in the direction of the axis of the press ram, that the intended adaptation of the position of the individual strippers to the shape of the stripping edge, changing from one hollow article to the other, is obtained during the stripping process only if the resistance offered by the hollow article against the stripping action is in a range corresponding to the elasticity of the springs or of the ring. In case the resistance is too small or too large, the conventional devices, however, are ineffective since either there is no compression of the ring or springs at all, or a complete compression up to the rear end position of the springs or of the ring takes place. Corresponding remarks apply for the radial displacements or pivotal movements of the strippers regarding the force with which the strippers contact the hollow article while the press ram with the hollow article passes through, so that the surface of the article may be damaged. Another disadvantage of the above-described conventional arrangements resides in that no means are provided therein, or could be provided therein in a simple manner, for displacing the bearing segments and together therewith the strippers in cyclic or rhythmic operation positively in the radial direction toward the outside so as to make it possible for the press ram with the hollow article to pass through without any contact during the working cycle of the press ram.

The present invention contemplates constructing the bearing of the bearing segments and of the strippers so that the elastic forces with which the strippers contact the stripping edge of the hollow article during the stripping step can be adapted in a simple manner to the respective resistance offered by the hollow article during the stripping step, and that simultaneously a displaceablility of the individual strippers in the direction of the axis of the press ram can be attained to a relatively large extent. This construction makes it possible under all conditions which may arise for the strippers to contact the irregularly shaped stripping edge of the hollow article without appreciable deformation, thus effecting the stripping step.

The invention further contemplates a construction wherein several bearing segments are disposed in a stripper supporting ring to be radially displaceable to a limited extent; wherein at least one stripper is mounted in each bearing segment to be displaceable within limits in the direction of the press ram axis; wherein each stripper includes an external operating piston and an internal stripping piston connected therewith, the inner surface of the latter forming a part of the inner surface of the bearing segment, a stripping end face of this internal stripping piston being extendable out of the end face of the bearing segment facing the hollow article during the stripping step; and wherein the end face of the operating piston facing away from the stripping end face of the stripping piston is connected with a controllable source of a pressure medium.

A particularly simple preferred embodiment of this invention is obtained by mounting, in the stripper supporting ring, three bearing segments encompassing each a sector angle of about 120°, and by arranging in each bearing segment several strippers disposed at equal spacings from one another. Three bearing segments can be supported in the stripper supporting ring in a relatively advantageous manner, wherein numerous strippers can suitably be distributed over the circumference of the press ram.

In order to simplify the feeding of pressure medium to the strippers, the feature is provided according to the invention that a connection duct is arranged in each bearing segment, terminating at the end faces of all operating pistons mounted therein which are exposed to the pressure medium. This connection duct is in communication with a pressure medium feed source.

This invention contemplates several preferred embodiments with various means for evoking radial displacements of the bearing segments with respect to the stripper supporting ring.

One preferred embodiment includes at least one spring engaging the bearing segments which displace these segments radially inwardly by elastic action. The inner surfaces of the bearing segments are beveled conically toward the outside at the end facing away from the stripping end faces of the stripping pistons. In this arrangement, the bearing segments are each shifted radially toward the outside by the hollow article by means of the beveled surface each time the press ram with the hollow article passes through. This mode of operation can also be attained in another embodiment wherein each bearing segment contains at least one pressure medium space of variable volume in communication with the pressure medium source. Radially outward boundary surfaces of this space being formed by the stripper supporting ring so that the pressure medium continuously applies a radially inward force on the bearing segments. As in the embodiment with the spring, the inner surfaces of the bearing segments have an outwardly pointing, conical bevel at the end facing away from the stripping end faces of the stripping pistons. These two embodiments are especially suitable for devices for the stripping off of such hollow articles wherein the external surface is not particularly sensitive so that the continuous radially inward biasing forces on said bearing segments does not damage the external surface during passage of the hollow articles.

However, for devices to strip off hollow articles having a very sensitive outer surface, more suitable embodiments of the invention are provided wherein the bearing segments are forcibly displaced alternatingly radially outwardly and inwardly in correspondence with the operating and stripping cycles of the press ram.

A preferred embodiment with forcible alternating radial displacement of the bearing segments includes at least one spring engaging the bearing segments and moving same elastically radially toward the outside. Respectively one roller, rotatably mounted in each bearing segment, contacts in the radial direction a guide track on the outside, which track is arranged in a guide ring moving about the axis of the press ram and rotatably disposed in the stripper supporting ring. This track effects the rhythmically alternating movements of the bearing segments radially inwardly and makes it possible for such movements to take place radially outwardly in response to the spring forces as well. In this arrangement, the guide track has, in each case, a number of inwardly and outwardly pointing beveled or inclined ramp surfaces between circular sections with two different radii which corresponds to the number of bearing segments provided. Another modification of this arrangement resides in that each bearing segment consists of an outer part carrying the roller, which outer part is also engaged by the spring effecting the radially outward displacement, and of an inner part carrying the strippers. This inner part is radially movable within limits with respect to the outer part and a compression spring is located between the outer part and the inner part. By the division of each bearing segment into an outer part and an inner part, an exact contact of the inner part with the strippers at the press ram is facilitated during the stripping step.

The effect of alternating, positive radial displacements of the bearing segments toward the inside and toward the outside can also be attained according to another preferred embodiment of the invention by providing that each bearing segment contains at least one pressure medium space of variable volume in communication with the pressure medium feed source. The boundary surface of this space, which is disposed inwardly in the radial direction, is connected with the stripper supporting ring. Respectively one roller mounted rotatably to each bearing segment contacts in the radial direction on the outside a guide track provided in a guide ring moving about the axis of the press ram and rotatably disposed in the stripper supporting ring, which guide track effects the rhythmically alternating displacements of the bearing segments radially inwardly and makes it possible for such displacements to take place radially outwardly as well. Also in this embodiment, the guide track has inclined surfaces between circular sections.

The effect of alternating, positive radial displacements can also be attained according to yet another preferred embodiment of the invention with the use of two corresponding guide tracks at the guide ring. Two rollers are mounted at each bearing segment with one of these rollers contacting respectively one guide track on the outside in the radial direction and the other of these rollers contacting respectively the other guide track on the inside in the radial direction. The guide tracks are located on a guide ring revolving about the axis of the press ram and rotatably mounted in the stripper supporting ring to effect rhythmically alternating displacements of the bearing segments radially inwardly and outwardly. In a further modification of this embodiment each bearing segment includes an outer part carrying the rollers and an inner part radially displaceable within limits with respect to the outer part and carrying the strippers. A compression spring is arranged between the outer part and the inner part. This provides additionally the effect attainable by the division of the bearing segments described above for another embodiment.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
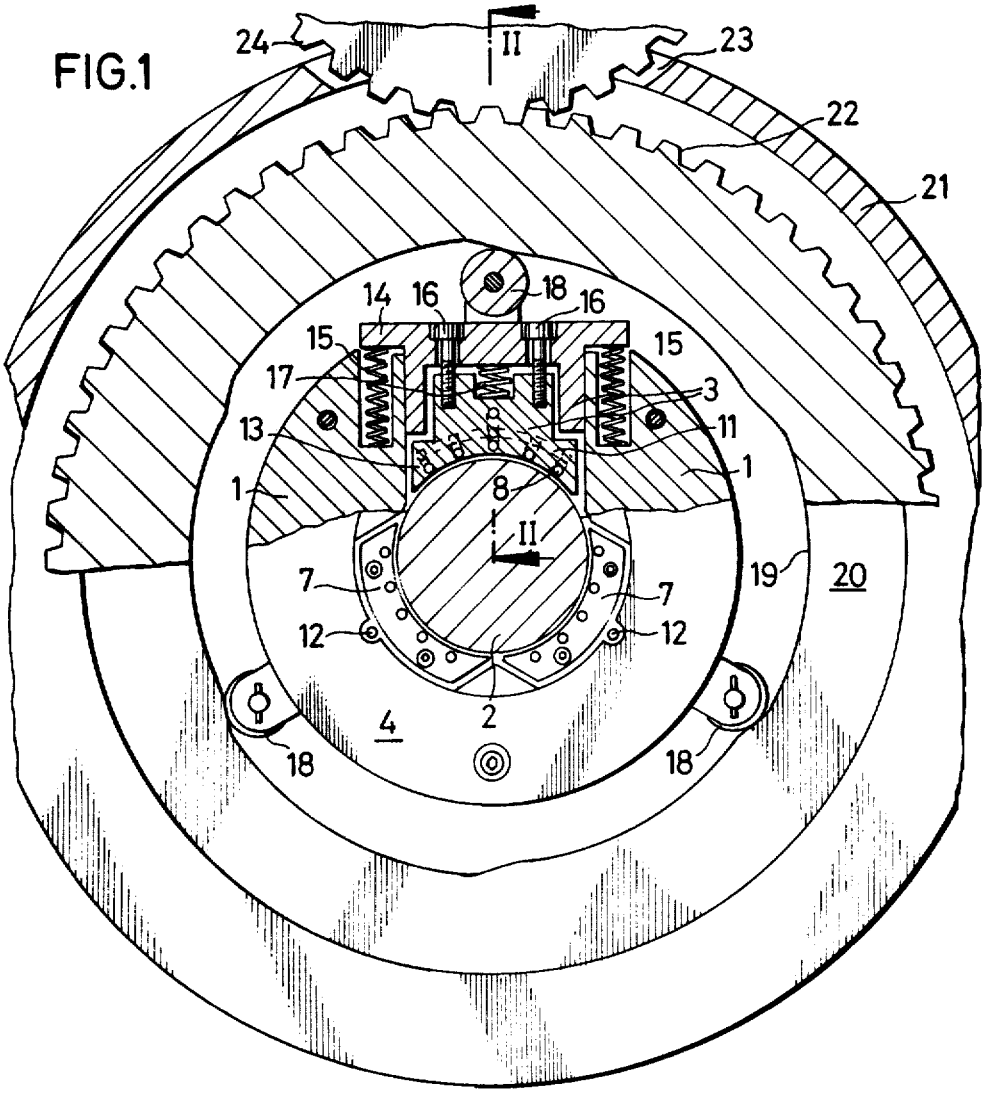
FIG. 1 is a front partial view along line I—I in FIG. 2 illustrating a first embodiment of the invention.

Throughout the various views, like reference numerals are used to designate like features.

Figure 2:
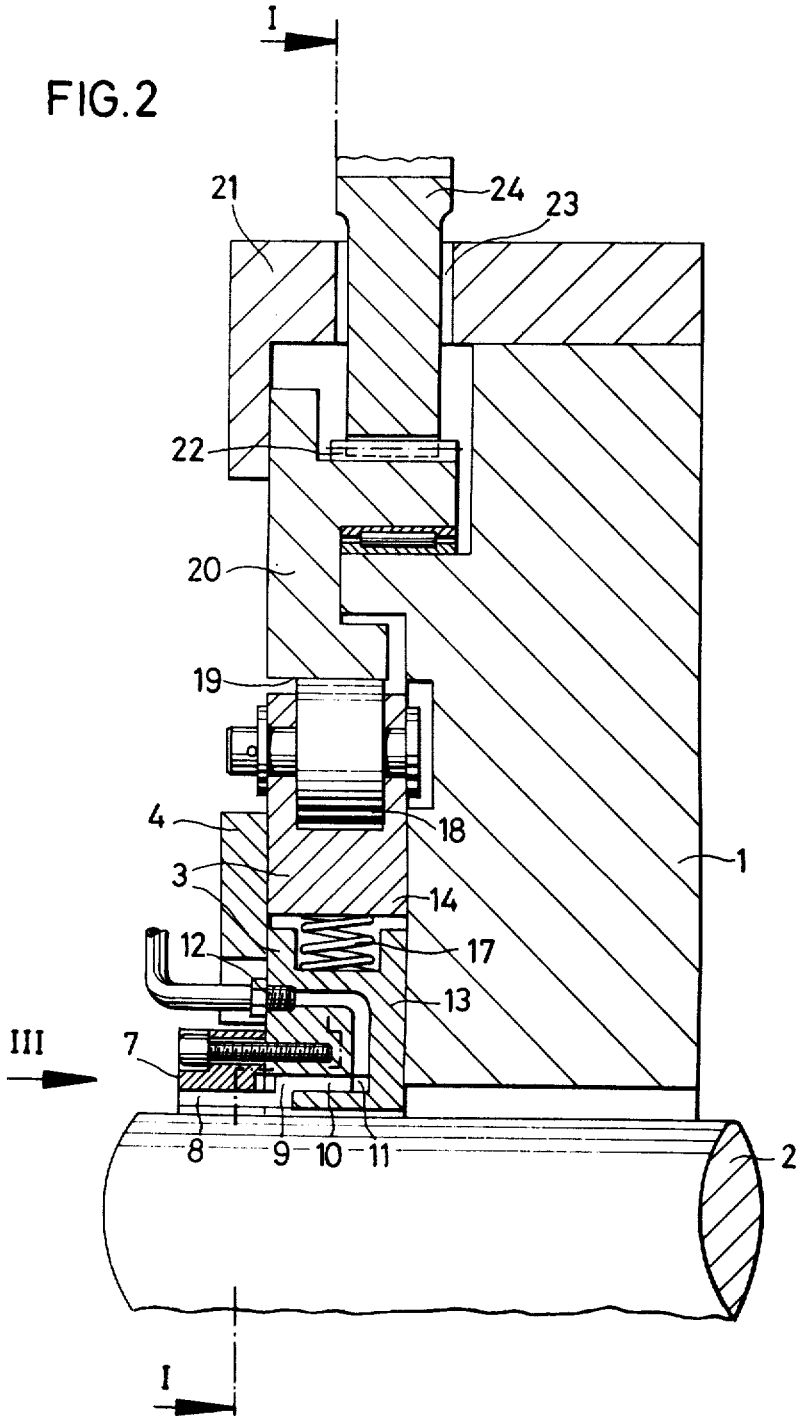
FIG. 2 is a sectional view along line II—II in FIG. 1.

Referring to FIGS. 1 and 2, a stripper supporting ring 1 encompasses a press ram 2 at a radial distance. Bearing segments 3 (each including two parts 13 and 14) are held in the direction of the axis of the press ram 2 by an annular disk 4 threadedly connected with the stripper supporting ring 1. Bearing segments 3 are mounted to be displaceable in the radial direction to a limited extent. The divided, radially inwardly disposed section 13 of each bearing segment 3 has several chamfered gated bores laterally open toward the press ram 2; which bores emanate from end face 7 of the bearing segment 3 facing stripping edge 5 of the hollow article 6 (see FIG. 4 for showing of edge 5 on article 6). Chamfered stripping pistons 8 of strippers 9 are displaceably disposed in these bores. Each stripper 9 also includes an operating piston 10 connected with the stripping piston 8 in the zone of its end facing away from the end face 7 of the bearing segment 3. This operating piston 10 is movably mounted in a further bore in the radially inwardly located section of the bearing segment 3 as best shown in FIG. 2. The movability of the strippers 9 in the direction of the axis of the press ram (direction parallel to the axis of press ram 2) is limited by the radially offset relationship of the stripping pistons 8 with respect to the operating pistons 10 and by the arrangement of the associated bores (see FIG. 2). In each bearing segment 3, a connecting duct 11 is provided terminating oppositely to the end faces of the operating pistons 10 facing away from the end face 7 of the bearing segment 3 and being in communication with a pressure medium feed source via a connection 12.

Figure 3:
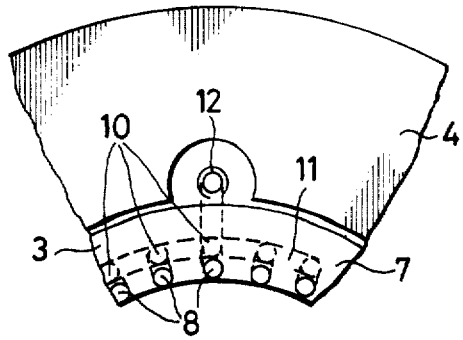
FIG. 3 is a fragmental view as seen in the direction of the arrow III in FIG. 2.

In the first embodiment (FIGS. 1–3), each bearing segment 3 includes an inner part 13, wherein the strippers 9 are mounted and the connection 12 is provided, and an outer part 14 engaged by two springs 15 acting radially outwardly, these springs 15 resting on the stripper supporting ring 1. The inner part 13 is guided to be radially movable to a limited extent with play as regards the outer part 14, namely by means of two screws 16 inserted in the inner part 13, the neck and head of these screws 16 having a play or clearance with respect to the passage bore and the mounting in the outer part 14. Furthermore, a compression spring 17 is arranged between the outerpart 14 and the inner part 13. Also, a roller 18 is rotatably mounted at the outer part 14. This roller 18 contacts in the radial direction the outside of the guide track 19 provided at guide ring 20 which is disposed in the stripper supporting ring 1 to be rotatable about the axis of the press ram 2. The guide ring 20 is retained, in the direction of the axis of press ram 2, by means of the outer ring 21 threadedly joined to the stripper supporting ring 1. The guide ring 20 is driven by an outer teeth set 22 arranged at this ring, these teeth 22 being engaged by a gear wheel 24 through a slot 23 in the outer ring 21. The rotation of gear wheel 24 is synchronized to the press ram movements so that the bearing segments are pushed radially inwardly during stripping operations but are permitted to move outwardly during other press operations. In this manner, the strippers are positively maintained spaced from the surface of the hollow article except during stripping operation.

Figure 4:
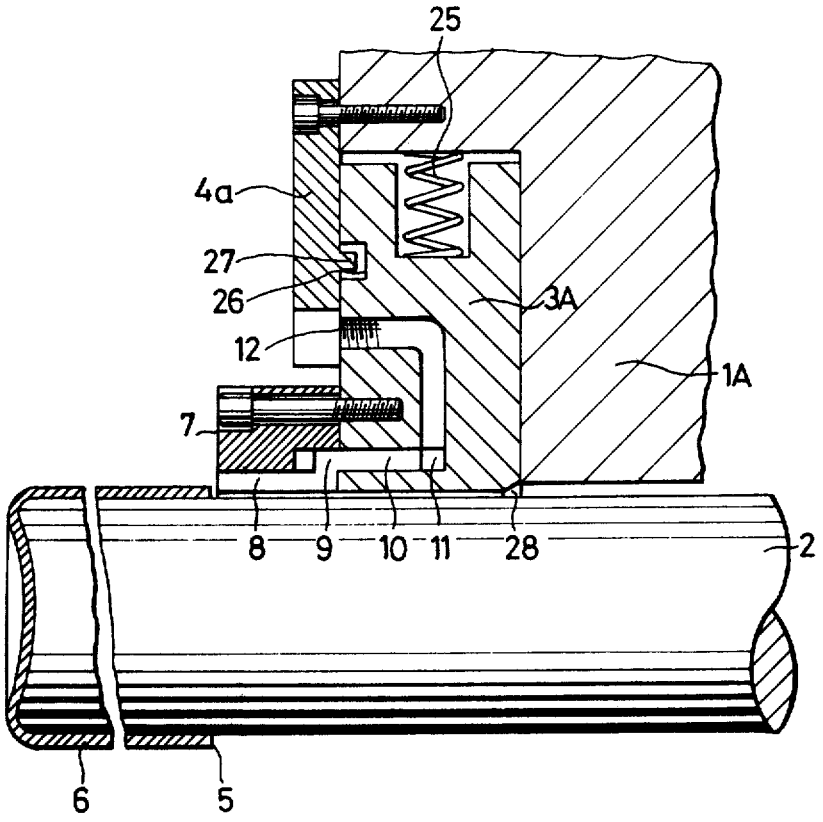
FIG. 4 is a fragmental sectional side view similar to FIG. 2 of a second embodiment of the invention.

In the second preferred embodiment shown in FIG. 4, a radially inwardly acting spring 25, which spring rests on supporting ring 1A, engages each bearing segment 3A. Each bearing segment 3A is formed in one part as compared to the two part segments 3 of FIGS. 1 and 2. Respectively one lug 27 engaging an elongated recess 26 in each bearing segment 3A is provided at the annular disk 4A to limit the radial displacements of the bearing segments 3A toward the inside. The inner surface of each bearing segment 3A has an outwardly oriented conical bevel 28 at its end facing away from the end face 7. During the passage of the press ram 2 with the hollow article 6, the bearing segments 3A are shifted radially against springs 25 outwardly by means of the bevel 28.

Figure 5:
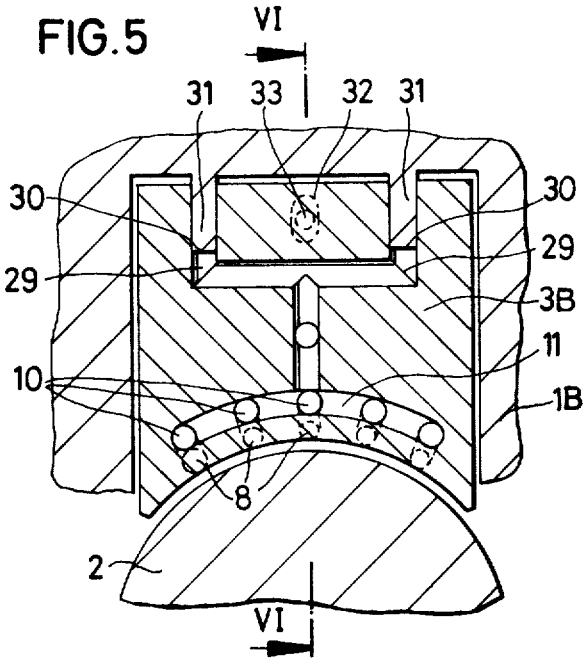
FIG. 5 is a sectional view along line V—V in FIG. 6 illustrating a third embodiment of the invention.
Figure 6:
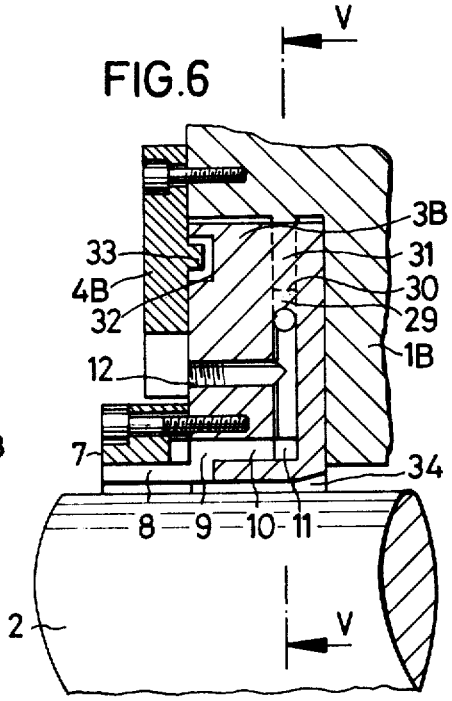
FIG. 6 is a sectional view along line VI—VI in FIG. 5.

In the third preferred embodiment shown in FIGS. 5 and 6, two pressure medium spaces 29 which are in communication with the connection 12 are provided in each bearing segment 3B. The radially outward boundary surfaces 30 of the pressure medium spaces 29 are formed on piston-like extensions 31 of the stripper supporting ring 1B which extend into the pressure medium spaces 29. The displacements of the bearing segments 3B radially inwardly, effected by the feeding of pressure medium, are limited by the provision of a lug 33 at the annular disk 4B, respectively engaging an elongated recess 32 in each bearing segment 3B. The inner surface of each bearing segment 3B has, at its end facing away from the end face 7, an outwardly pointing, conical bevel 34, over which the bearing segments 3B are displaced radially outwardly against the biasing force of the pressure medium in space 29.

Figure 7:
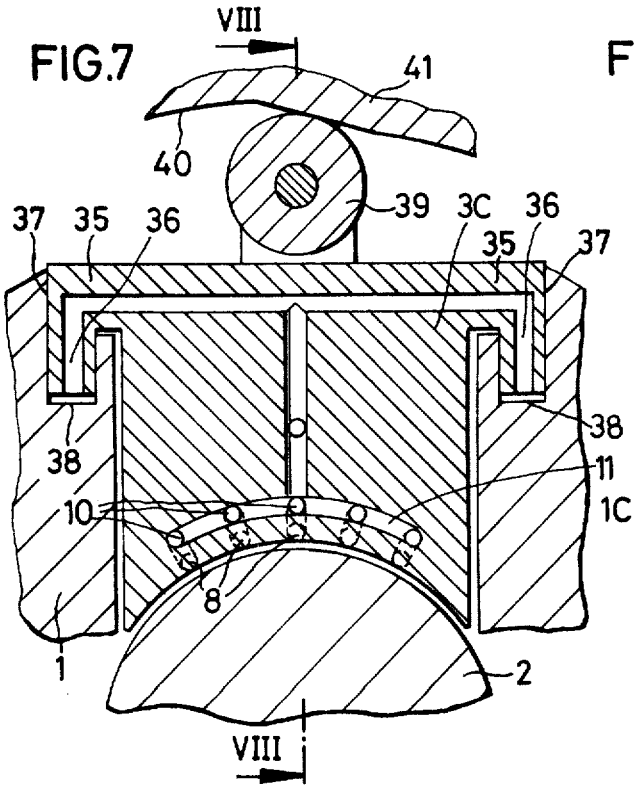
FIG. 7 is a sectional view along line VII—VII in FIG. 8 illustrating a fourth embodiment of the invention.
Figure 8:
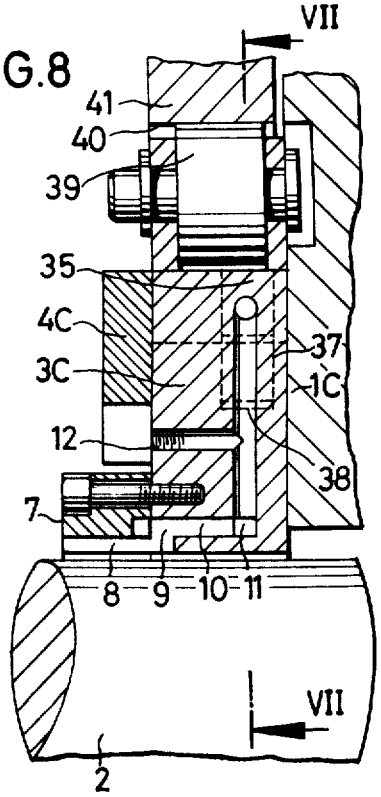
FIG. 8 is a sectional view along line VIII—VIII in FIG. 7.

In the fourth preferred embodiment shown in FIGS. 7 and 8, two pressure medium spaces 36 are provided in each bearing segment 3C in two lateral projections 35. These spaces 36 are in communication with the connection 12. The projections 35 extend, in the manner of hollow pistons, into cylinder bores 37 in the stripper supporting ring 1C. At supporting ring 1C, the boundary surfaces 38 of the pressure medium spaces 36, disposed on the inside in the radial direction, are provided. The radially outward displacements of the bearing segments 3C, effected by the exposure to the pressure medium, act, via the rollers 39 rotatably mounted at the bearing segments 3C, on the guide track 40 at the guide ring 41 which is rotatable about the axis of the press ram 2. The radially inward displacements of the bearing segments 3C are effected by the inclined surfaces in the guide track 40.

Figure 9:
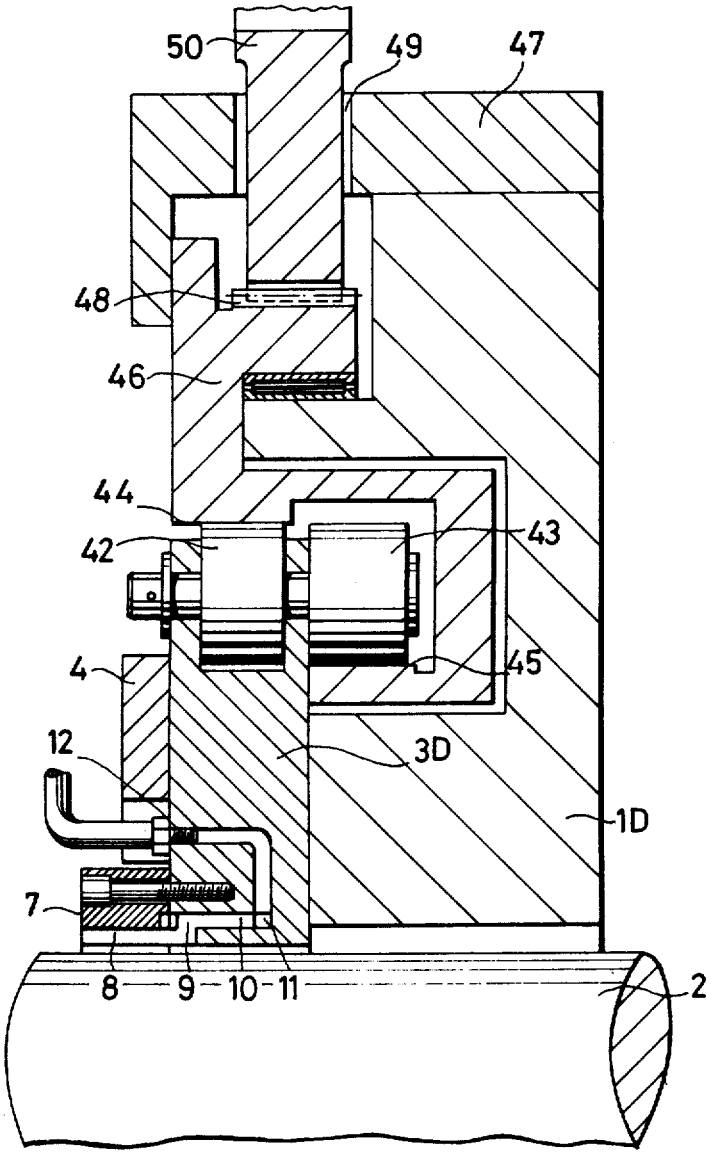
FIG. 9 is a half-sectional view along the axis of the press ram similar to FIG. 2 which illustrates a fifth embodiment of the invention.

In the fifth preferred embodiment shown in FIG. 9, two rollers 42, 43 are rotatably mounted at each bearing segment 3B. One roller 42 contacts a guide track 44 on the outside in the radial direction and the other roller 43 contacts a guide track 45 on the inside in the radial direction. Both guide tracks 44, 45 are provided at a guide ring 46 rotatably disposed at the stripper supporting ring 1 to be movable about the axis of the press ram 2. The guide ring 46 is retained in the direction of the axis of the press ram 2 by means of outer ring 47 threadedly joined to the stripper supporting ring 1D. The guide ring 46 is driven by way of outer teeth 48 arranged at this ring, which teeth are engaged by a gear wheel 50 through a slot 49 in the outer ring 47. The radial movements of the bearing segments 3D toward the inside and toward the outside are positively effected by the inclined surfaces in the guide tracks 44, 45 (see FIG. 1 and associated description of corresponding guide tracks).

In all embodiments the pressure medium supplied by way of connection 12 is maintained sufficiently high, in conjunction with the design of the stripper pistons and the variable volume spaces for radial support and movement of the segments, to carry out the described functions.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Apparatus for stripping articles from a press ram comprising:

at least one stripper having a part thereof engageable with an article on a press ram to forcibly strip the article from the press ram, stripper support means for supporting and guiding each of said at least one strippers for movement substantially parallel to a press ram axis of said press ram and for movement transverse to said press ram axis, and fluid pressure medium stripper control means for applying a fluid pressure medium to each of said press ram axis to force said stripper against the article to strip the same from the press ram.

2. Apparatus according to claim 1, wherein a plurality of separate strippers are provided which are spaced from one another in said stripper support means for engagement with an article at respective circumferentially spaced locations on said press ram.

3. Apparatus according to claim 2, wherein said pressure medium stripper control means includes means for permitting movement of respective ones of said strippers different distances with respect to said stripper support means to accommodate irregularities in the end face of an article being stripped from said press ram.

4. Apparatus for stripping articles from a press ram comprising:

at least one stripper having a part thereof engageable with an article on a press ram to forcibly strip the article from the press ram, stripper support means for supporting and guiding each of said at least one strippers for movement substantially parallel to a press ram axis of said press ram and for movement transverse to said press ram axis, and pressure medium stripper control means for applying a pressure medium to each of said at least one strippers in a direction substantially parallel to said press ram axis, wherein a plurality of separate strippers are provided which are spaced from one another in said stripper support means for engagement with an article at respective circumferentially spaced locations on said press ram, wherein said stripper support means includes a stripper supporting ring which in use extends circumferentially around the press ram, and a plurality of separate bearing segments circumferentially spaced from one another on said supporting ring, said bearing segments being mounted in said supporting ring for limited radial displacement with respect to said press ram axis, wherein each stripper includes an external operating piston and an internal stripping piston connected therewith, wherein radially inner surface portions of said stripping piston are aligned with radially inner surface portions of one of said bearing segments, wherein said stripping piston has a stripping end face engageable with said article during stripping of said article from said press ram, and wherein said operating piston is guidably mounted in one of said bearing segments and has an operating end face which faces away from the stripping end face and which is in communication with pressure medium supplied by said pressure medium stripper control means.

5. Apparatus according to claim 4, wherein three of said bearing segments are mounted on said supporting ring, said bearing segments each encompassing a sector angle of approximately 120°, and wherein a plurality of said equally spaced strippers are mounted in each bearing segment.

6. Apparatus according to claim 5, wherein said pressure medium stripper control means includes a pressure medium connection duct in each bearing segment, and wherein said connection duct communicates directly with the end faces of all operating pistons mounted in the respective bearing segment and with a pressure medium feed source.

7. Apparatus according to claim 4, wherein at least one elastic member elastically forces the bearing segments in the radially inward direction, and wherein a radially outwardly pointing conical bevel is provided at the radially inner surface portions of the bearing segments at the end of the bearing segments facing opposite said stripping end faces of said stripping pistons.

8. Apparatus according to claim 6, wherein at least one elastic member elastically forces the bearing segments in the radially inward direction, and wherein a radially outwardly pointing conical bevel is provided at the radially inner surface portions of the bearing segments at the end of the bearing segments facing opposite said stripping end faces of said stripping pistons.

9. Apparatus according to claim 4, wherein each bearing segment contains at least one variable volume pressure medium space which is in communication with a pressure medium feed source, said pressure medium space being bounded at least in part in the radially outward direction by said supporting ring and in the radially inward direction by said bearing segment such that an increase in pressure in said pressure medium space results in a radially inward force on said bearing segment.

10. Apparatus according to claim 9, wherein a radially outwardly pointing conical bevel is provided at the radially inner surface portions of the bearing segments at the end of the bearing segments facing opposite said stripping end faces of said stripping pistons.

11. Apparatus according to claim 6, wherein each bearing segment contains at least one variable volume pressure medium space which is in communication with a pressure medium feed source, said pressure medium space being bounded at least in part in the radially outward direction by said supporting ring and in the radially inward direction by said bearing segment such that an increase in pressure in said pressure medium space results in a radially inward force on said bearing segment and wherein a radially outwardly pointing conical bevel is provided at the radially inner surface portions of the bearing segments at the end of the bearing segments facing opposite said stripping end faces of said stripping pistons.

12. Apparatus for stripping articles from a press ram comprising:

at least one stripper having a part thereof engageable with an article on a press ram to forcibly strip the article from the press ram, stripper support means for supporting and guiding each of said at least one strippers for movement substantially parallel to a press ram axis of said press ram and for movement transverse to said press ram axis, and pressure medium stripper control means for applying a pressure medium to each of said at least one strippers in a direction substantially parallel to said press ram axis, wherein said stripper support means includes a stripper supporting ring which in use extends circumferentially around the press ram, and a plurality of separate bearing segments circumferentially spaced from one another on said supporting ring, each of said bearing segments including means for carrying at least one of said strippers and being mounted in said supporting ring for limited radial displacement with respect to said press ram axis, wherein elastic means are provided for elastically biasing said bearing segments in one of a radially inward and outward direction, and wherein interengageable guide member means and guide track means are provided for rhythmically alternating the radial displacement of said bearing segments against the force of said elastic means in response to relative movement of said guide member means and guide track means.

13. Apparatus according to claim 4, wherein elastic means are provided for elastically biasing said bearing segments in one of a radially inward and outward direction, and wherein interengageable guide member means and guide track means are provided for rhythmically alternating the radial displacement of said bearing segments against the force of said elastic means in response to relative movement of said guide member means and guide track means.

14. Apparatus according to claim 13, wherein said guide member means includes a guide roller rotatably mounted in each of said bearing segments, wherein said guide track means is an undulating guide track extending circumferentially around the press ram axis in a guide ring which guide ring is rotatably supported in said supporting ring for rotation about said press ram axis.

15. Apparatus according to claim 14, wherein said elastic means includes a spring for each bearing segment which biases said bearing segment in the radially outward direction so as to maintain the respective guide roller in contact with said guide track for all rotative positions of said guide ring with respect to said supporting ring.

16. Apparatus according to claim 15, wherein a plurality of said strippers are mounted in each bearing segment, wherein said pressure medium stripper control means includes a pressure medium connection duct in each bearing segment, and wherein said connection duct communicates directly with the end faces of all operating pistons mounted in the respective bearing segment and with a pressure medium feed source.

17. Apparatus according to claim 15, wherein each bearing segment includes an outer part carrying the guide roller and an inner part carrying at least one of the strippers, said outer part being biased outwardly by said spring, said inner part being radially movable to a limited extent with respect to the outer part, and wherein a compression spring is interposed between the outer part and the inner part.

18. Apparatus for stripping articles from a press ram comprising:

at least one stripper having a part thereof engageable with an article on a press ram to forcibly strip the article from the press ram, stripper support means for supporting and guiding each of said at least one strippers for movement substantially parallel to a press ram axis of said press ram and for movement transverse to said press ram axis, and pressure medium stripper control means for applying a pressure medium to each of said at least one strippers in a direction substantially parallel to said press ram axis, wherein said stripper support means includes a stripper supporting ring which in use extends circumferentially around the press ram, and a plurality of separate bearing segments circumferentially spaced from one another on said supporting ring, each of said bearing segments includes means for carrying at least one of said strippers and is mounted in said supporting ring for limited radial displacement with respect to said press ram axis, and wherein interengageable guide member means and guide track means are provided for rythmically alternating the radial displacement of said bearing segments in response to relative movement of said guide member means and said guide track means.

19. Apparatus according to claim 18, wherein biasing means are provided for continuously applying biasing forces on said bearing segments in one of a radially inward and outward direction, and wherein said interengageable guide member means and guide track means effect a radial displacement of said bearing segments against the biasing forces of said biasing means.

20. Apparatus according to claim 19, wherein said biasing means includes a fluid pressure medium.

21. Apparatus according to claim 20, wherein said fluid pressure medium is applied to a variable volume space bounded by radially outward facing surfaces of said supporting ring and radially inward facing surfaces of said bearing segments such that bearing segments are continuously biased outwardly by said pressure medium.

22. Apparatus according to claim 21, wherein said guide member means includes a guide roller rotatably mounted in each of said bearing segments, wherein said guide track means is an undulating guide track extending circumferentially around the press ram axis in a guide ring which guide ring is rotatably supported in said supporting ring for rotation about said press ram axis.

23. Apparatus according to claim 22, wherein each stripper includes an external operating piston and an internal stripping piston connected therewith, wherein radially inner surface portions of said stripping piston are aligned with radially inner surface portions of one of said bearing segments, wherein said stripping piston has a stripping endface engageable with said article during stripping of said article from said press ram, and wherein said operating piston is guidably mounted in one of said bearing segments and has an operating end face which faces away from the stripping end face and which is in communication with pressure medium supplied by said pressure medium stripper control means.

24. Apparatus according to claim 23, wherein the pressure medium supplied to said variable volume space is communicated directly to said operating pistons of said strippers.

25. Apparatus according to claim 18, wherein said guide member means includes two rollers rotatably supported at each bearing segment, wherein said guide track means includes a radially inwardly facing guide track in guiding contact with one of said rollers and a radially outwardly facing guide track in guiding contact with the other of said rollers, and wherein said guide tracks are provided at a guide ring extending about the axis of the press ram and rotatably mounted in the supporting ring.

26. Apparatus according to claim 25, wherein each of said guide tracks extend along a path having circular arc sections of different radii with respect to said ram axis, which circular arc sections are connected together by ramp sections.

27. Apparatus according to claim 25, wherein each stripper includes an external operating piston and an internal stripping piston connected therewith, wherein radially inner surface portions of said stripping piston are aligned with radially inner surface portions of one of said bearing segments, wherein said stripping piston has a stripping end face engageable with said article during stripping of said article from said press ram, and wherein said operating piston is guidably mounted in one of said bearing segments and has an operating end face which faces away from the stripping end face and which is in communication with pressure medium supplied by said pressure medium stripper control means.

28. Apparatus according to claim 25, wherein each bearing segment includes an outer part carrying the guide rollers and an inner part radially displaceable within limits with regard to the outer part, said inner part carrying the strippers, and wherein a compression spring is arranged between the outer part and the inner part.

29. Apparatus according to claim 27, wherein each bearing segment includes an outer part carrying the guide rollers and an inner part radially displaceable within limits with regard to the outer part, said inner part carrying the strippers, and wherein a compression spring is arranged between the outer part and the inner part.

30. Apparatus fo stripping articles from a press ram comprising:

at least one stripper having a part thereof engageable with an article on a press ram to forcibly strip the article from the press ram, and stripper support means for supporting and guiding each of said at least one strippers for movement substantially parallel to a press ram axis of said press ram and for movement transverse to said press ram axis, wherein said stripper support means includes a stripper supporting ring which in use extends circumferentially around the press ram, and a plurality of separate bearing segments circumferentially spaced from one another on said supporting ring, each of said bearing segments includes means for carrying at least one of said strippers and is mounted in said supporting ring for limited radial displacement with respect to said press ram axis, and wherein interengageable guide member means and guide track means are provided for rythmically alternating the radial displacement of said bearing segments in response to relative movement of said guide member means and said guide track means.

31. Apparatus according to claim 30, wherein biasing means are provided for continuously applying biasing forces on said bearing segments in one of a radially inward and outward direction, and wherein said interengageable guide member means and guide track means effect a radial displacement of said bearing segments against the biasing forces of said biasing means.

32. Apparatus according to claim 31, wherein said biasing means includes a fluid pressure medium.

33. Apparatus according to claim 31, wherein said biasing means includes spring means interposed between said supporting ring and said bearing segments.

34. Apparatus according to claim 30, wherein said guide member means includes roller means mounted on said bearing segments, and wherein said guide track means extends along a guide track ring which is rotatably mounted on said supporting ring such that relative rotation of said guide track ring and supporting ring effects predetermined undulating radial displacement of said bearing segments.

35. Apparatus for stripping articles from a press ram comprising:

at least one stripper having a part thereof engageable with an article on a press ram to forcibly strip the article from the press ram, stripper support means for supporting and guiding each of said at least one strippers for movement substantially parallel to a press ram axis of said press ram and for movement transverse to said press ram axis, and pressure medium stripper control means for selectively applying a pressure medium to each of said at least one strippers in a direction substantially parallel to said press ram axis and in the same direction as the direction of the power stroke of the press ram to force said stripper against the article to strip the same from the press ram.

36. Apparatus according to claim 35, wherein said stripper support means includes first means for supporting and guiding each of said at least one strippers for movement substantially parallel to the press ram axis and second means for supporting and guiding each of said at least one strippers for movement transverse to said press ram axis, said first and second support means being separate from one another and being configured to accommodate support and guidance of each of said at least one strippers for movement in one of said directions independently of the movement in the other of said directions.

37. Apparatus according to claim 35, wherein a plurality of separate strippers are provided which are spaced from one another in said stripper support means for engagement with an article at respective circumferentially spaced locations on said press ram.

38. Apparatus according to claim 37, wherein said pressure mediuum stripper control means includes means for permitting movement of respective ones of said strippers different distances with respect to said stripper support means to accommodate irregularities in the end face of an article being stripped from said press ram.

* * * * *